US010443173B2

(12) United States Patent
Hall et al.

(10) Patent No.: US 10,443,173 B2
(45) **Date of Patent: *Oct. 15, 2019**

(54) YARN COLOR PLACEMENT SYSTEM

(71) Applicant: Card-Monroe Corp., Chattanooga, TN (US)

(72) Inventors: Wilton Hall, Ringgold, GA (US); Kendall Johnston, Dalton, GA (US)

(73) Assignee: Card-Monroe, Corp., Chattanooga, TN (US)

( * ) Notice: Subject to any disclaimer, the term of this patent is extended or adjusted under 35 U.S.C. 154(b) by 362 days.

This patent is subject to a terminal disclaimer.

(21) Appl. No.: 15/193,652

(22) Filed: Jun. 27, 2016

(65) Prior Publication Data

US 2016/0305055 A1 Oct. 20, 2016

Related U.S. Application Data

(63) Continuation of application No. 14/321,152, filed on Jul. 1, 2014, now Pat. No. 9,410,276, which is a (Continued)

(51) Int. Cl.
*D05C 15/30* (2006.01)
*D05C 15/26* (2006.01)
(Continued)

(52) U.S. Cl.
CPC ..... *D05C 15/30* (2013.01); *D05C 15/26* (2013.01); *D05C 15/32* (2013.01); *D05C 15/34* (2013.01); *D05C 15/36* (2013.01)

(58) Field of Classification Search
CPC ..... D05C 15/26; D05C 15/28; D05C 15/30; D05C 15/32; D05C 15/34; D05C 15/36
See application file for complete search history.

(56) References Cited

U.S. PATENT DOCUMENTS 2,811,244 A 10/1957 MacCaffray, Jr.
2,818,037 A 12/1957 McNutt
(Continued)

FOREIGN PATENT DOCUMENTS

EP 1 474 354 7/2010
EP 2 100 994 6/2011
(Continued)

OTHER PUBLICATIONS

Defendant Tuftco Corp.'s Amended Invalidity and Non-Infringement Contentions filed Dec. 9, 2015, *Card-Monroe Corp.* v. *Tuftco Corp.*, E.D. Tenn., Case No. 1:14-cv-292.
(Continued)

*Primary Examiner* — Nathan E Durham
(74) *Attorney, Agent, or Firm* — Womble Bond Dickinson (US) LLP

(57) ABSTRACT

A yarn color placement system for a tufting machine including a series of different color yarns being fed to the needles of the tufting machine by yarn feed mechanisms. A backing material is fed through the tufting machine at an increased stitch rate as the needles are shifted according to the programmed pattern steps. A series of level cut loop loopers or hooks engage and pick loops of yarns from the needles, with the clips of the level cut loop loopers or hooks being selectively actuated to form cut pile tufts, while the remaining loops of yarns can be back-robbed so as to be hidden from view in the finished patterned tufted article.

19 Claims, 8 Drawing Sheets

Related U.S. Application Data continuation of application No. 13/422,238, filed on Mar. 16, 2012, now Pat. No. 8,776,703, which is a continuation of application No. 12/122,004, filed on May 16, 2008, now Pat. No. 8,141,505.

(60) Provisional application No. 61/029,105, filed on Feb. 15, 2008.

(51) Int. Cl.

| | |
|---|---|
| ***D05C 15/32*** | (2006.01) |
| ***D05C 15/34*** | (2006.01) |
| ***D05C 15/36*** | (2006.01) |

(56) References Cited

U.S. PATENT DOCUMENTS

| | | | |
|---|---|---|---|
| 2,840,019 | A | 6/1958 | Beasley |
| 2,842,259 | A | 7/1958 | Hoeselbarth |
| 2,866,424 | A | 12/1958 | Masland, II |
| 2,883,735 | A | 4/1959 | Hoeselbarth |
| 2,932,181 | A | 4/1960 | MacCaffray, Jr. |
| 2,965,054 | A | 12/1960 | Masland, II |
| 2,966,866 | A | 1/1961 | Card |
| 2,983,028 | A | 5/1961 | Cole |
| 2,990,792 | A | 7/1961 | Nowicki et al. |
| 2,991,738 | A | 7/1961 | Zenner et al. |
| 2,968,856 | A | 12/1961 | Allen |
| 3,016,029 | A | 1/1962 | Card |
| 3,026,029 | A | 1/1962 | Card |
| 3,026,830 | A | 3/1962 | Bryant et al. |
| 3,056,364 | A | 10/1962 | Dedmon |
| 3,067,701 | A | 12/1962 | Wilcox |
| 3,084,644 | A | 4/1963 | Card |
| 3,084,645 | A | 4/1963 | Card |
| 3,091,199 | A | 5/1963 | Ballard |
| 3,095,840 | A | 7/1963 | Ballard |
| 3,095,841 | A | 7/1963 | Ballard |
| 3,103,903 | A | 9/1963 | Broadrick et al. |
| 3,109,395 | A | 11/1963 | Batty et al. |
| 3,160,125 | A | 12/1964 | Bryant et al. |
| 3,162,155 | A | 12/1964 | Charles |
| 3,177,833 | A | 4/1965 | Passons |
| 3,202,379 | A | 8/1965 | Dedmon et al. |
| 3,203,388 | A | 8/1965 | Parlin et al. |
| 3,220,371 | A | 11/1965 | Short et al. |
| 3,259,088 | A | 7/1966 | Rockholt |
| 3,272,163 | A | 9/1966 | Erwin, Jr. et al. |
| 3,332,379 | A | 7/1967 | Cobble, Sr. et al. |
| 3,361,096 | A | 1/1968 | Watkins |
| 3,375,797 | A | 4/1968 | Gaines |
| 3,393,654 | A | 7/1968 | Barnes |
| 3,396,687 | A | 8/1968 | Nowicki |
| 3,433,188 | A | 3/1969 | Pickles |
| 3,435,787 | A | 4/1969 | Short |
| 3,485,195 | A | 12/1969 | Torrence |
| 3,490,399 | A | 1/1970 | Hesz |
| 3,547,058 | A | 12/1970 | Wembley et al. |
| 3,554,147 | A | 1/1971 | Spanel |
| 3,577,943 | A | 5/1971 | Watkins |
| 3,585,948 | A | 6/1971 | Cobble |
| 3,605,660 | A | 9/1971 | Short |
| 3,618,542 | A | 11/1971 | Zocher |
| 3,623,440 | A | 11/1971 | Spedding et al. |
| 3,662,697 | A | 5/1972 | Passons et al. |
| 3,670,672 | A | 6/1972 | Spanel |
| 3,688,804 | A | 9/1972 | Brown et al. |
| 3,701,464 | A | 10/1972 | Crum |
| 3,709,173 | A | 1/1973 | Greene |
| 3,752,094 | A | 8/1973 | Short |
| 3,752,095 | A | 8/1973 | Brown et al. |
| 3,757,709 | A | 9/1973 | Cobble |
| 3,812,799 | A | 5/1974 | Spanel et al. |
| 3,824,939 | A | 7/1974 | Spanel et al. |
| 3,835,797 | A | 9/1974 | Franks et al. |
| 3,842,767 | A | 10/1974 | Short |
| 3,847,098 | A | 11/1974 | Hammel, Jr. |
| 3,865,059 | A | 2/1975 | Jackson |
| 3,875,883 | A | 4/1975 | Eberwein et al. |
| 3,881,432 | A | 5/1975 | Dodd et al. |
| 3,908,881 | A | 9/1975 | McCann |
| 3,919,953 | A | 11/1975 | Card et al. |
| 3,934,524 | A | 1/1976 | Smith |
| 3,937,156 | A | 2/1976 | Spanel |
| 3,937,157 | A | 2/1976 | Spanel et al. |
| 3,937,158 | A | 2/1976 | Spanel |
| 3,937,159 | A | 2/1976 | Spanel |
| 3,937,160 | A | 2/1976 | Spanel et al. |
| 3,943,865 | A | 3/1976 | Short et al. |
| 3,972,295 | A | 8/1976 | Smith |
| 3,978,800 | A | 9/1976 | Card et al. |
| 3,982,491 | A | 9/1976 | Herzer et al. |
| 4,015,550 | A | 4/1977 | Bartenfeld et al. |
| 4,029,030 | A | 6/1977 | Smith |
| 4,047,491 | A | 9/1977 | Spanel et al. |
| 4,048,930 | A | 9/1977 | Card |
| 4,064,816 | A | 12/1977 | Spanel et al. |
| 4,089,281 | A | 5/1978 | Landoni |
| 4,100,863 | A | 7/1978 | Shortte, Jr. |
| 4,103,629 | A | 8/1978 | Card |
| 4,106,416 | A | 8/1978 | Blackstone, Jr. et al. |
| 4,119,047 | A | 10/1978 | Spanel et al. |
| 4,127,078 | A | 11/1978 | Spanel et al. |
| 4,134,347 | A | 1/1979 | Jolley et al. |
| 4,134,348 | A | 1/1979 | Scott |
| 4,138,956 | A | 2/1979 | Parsons |
| 4,154,176 | A | 5/1979 | Spanel et al. |
| 4,155,319 | A | 5/1979 | Short |
| 4,170,949 | A | 10/1979 | Lund |
| 4,173,192 | A | 11/1979 | Schmidt et al. |
| 4,185,569 | A | 1/1980 | Inman |
| 4,193,358 | A | 3/1980 | Woodcock |
| 4,195,580 | A | 4/1980 | Hurst |
| 4,221,317 | A | 9/1980 | Fukada et al. |
| 4,224,884 | A | 9/1980 | Shortte, Jr. |
| 4,241,675 | A | 12/1980 | Bardsley |
| 4,241,676 | A | 12/1980 | Parsons et al. |
| 4,244,309 | A | 1/1981 | Spanel et al. |
| 4,245,794 | A | 1/1981 | Hasegawa et al. |
| 4,254,718 | A | 3/1981 | Spanel et al. |
| 4,255,050 | A | 3/1981 | Beckstein et al. |
| 4,261,498 | A | 4/1981 | Short |
| 4,267,787 | A | 5/1981 | Fukuda |
| 4,303,024 | A | 12/1981 | Bardsley |
| 4,303,189 | A | 12/1981 | Wiley et al. |
| 4,313,388 | A | 2/1982 | Biggs et al. |
| 4,317,419 | A | 3/1982 | Spanel et al. |
| 4,320,711 | A | 3/1982 | Slattery |
| 4,353,317 | A | 10/1982 | Crumbliss |
| 4,365,565 | A | 12/1982 | Kawai et al. |
| 4,366,761 | A | 1/1983 | Card |
| 4,369,720 | A | 1/1983 | Beasley |
| 4,370,937 | A | 2/1983 | Denny |
| 4,384,538 | A | 5/1983 | Slattery |
| 4,393,793 | A | 7/1983 | Beasley |
| 4,397,249 | A | 8/1983 | Slattery |
| 4,399,758 | A | 8/1983 | Bagnall |
| 4,401,024 | A | 8/1983 | Frentress |
| 4,419,944 | A | 12/1983 | Passons et al. |
| 4,429,648 | A | 2/1984 | Slattery |
| 4,440,102 | A | 4/1984 | Card et al. |
| 4,445,447 | A | 5/1984 | Bardsley et al. |
| 4,448,137 | A | 5/1984 | Curtis et al. |
| 4,466,366 | A | 8/1984 | Hirotsu |
| 4,469,037 | A | 9/1984 | Bost, Jr. |
| 4,483,260 | A | 11/1984 | Gallant |
| 4,501,212 | A | 2/1985 | Slattery |
| 4,519,332 | A | 5/1985 | Fukuda |
| 4,522,132 | A | 6/1985 | Slattery |
| 4,528,921 | A | 7/1985 | Slattery |
| 4,531,465 | A | 7/1985 | Hampton |
| 4,548,140 | A | 10/1985 | Price et al. |
| 4,549,496 | A | 10/1985 | Kile |
| 4,557,208 | A | 12/1985 | Ingram et al. |

(56) References Cited

U.S. PATENT DOCUMENTS 4,574,716 A 3/1986 Czelusniak, Jr.
4,586,445 A 5/1986 Card et al.
4,597,344 A 7/1986 Stutznacker
4,608,935 A 9/1986 Bardsley
4,619,212 A 10/1986 Card et al.
4,630,558 A 12/1986 Card et al.
4,637,329 A 1/1987 Czelusniak, Jr.
4,653,293 A 3/1987 Porat
4,653,413 A 3/1987 Bagnall
4,665,845 A 5/1987 Card et al.
4,667,611 A 5/1987 Yamamoto et al.
4,669,171 A 6/1987 Card et al.
4,682,554 A 7/1987 Goto et al.
4,686,918 A 8/1987 Hjalmer et al.
4,688,497 A 8/1987 Card et al.
4,693,190 A 9/1987 Slattery
D293,323 S 12/1987 Slattery et al.
4,726,306 A 2/1988 Crumbliss
4,741,000 A 4/1988 Fukuda
4,786,177 A 11/1988 Beckstein et al.
4,790,252 A 12/1988 Bardsley
4,794,874 A 1/1989 Slattery
4,815,401 A 3/1989 Bagnall
4,815,402 A 3/1989 Price
4,815,403 A 3/1989 Card et al.
4,817,541 A 4/1989 Magourik
4,829,917 A 5/1989 Morgante et al.
4,831,948 A 5/1989 Itoh et al.
4,836,118 A 6/1989 Card et al.
4,841,886 A 6/1989 Watkins
4,849,270 A 7/1989 Evans et al.
4,852,505 A 8/1989 Dedmon
4,856,441 A 8/1989 Kurata
4,860,674 A 8/1989 Slattery
4,864,946 A 9/1989 Watkins
4,867,080 A 9/1989 Taylor et al.
4,870,915 A 10/1989 Bagnall
4,890,924 A 1/1990 Beckstein
4,903,624 A 2/1990 Card et al.
4,903,625 A 2/1990 Card et al.
4,981,091 A 1/1991 Taylor et al.
4,991,523 A 2/1991 Ingram
5,005,498 A 4/1991 Taylor et al.
5,035,030 A 7/1991 Pellari
5,058,518 A 10/1991 Card et al.
5,080,028 A 1/1992 Ingram
5,094,178 A 3/1992 Watkins
5,143,003 A 9/1992 Dedmon
5,158,027 A 10/1992 Ingram
5,165,352 A 11/1992 Ingram
5,182,997 A 2/1993 Bardsley
5,189,966 A 3/1993 Satterfield
5,205,233 A 4/1993 Ingram
5,224,434 A 7/1993 Card et al.
5,267,520 A 12/1993 Ingram
5,295,450 A 3/1994 Neely
5,383,415 A 1/1995 Padgett, III
5,392,723 A 2/1995 Kaju
5,400,727 A 3/1995 Neely
5,413,832 A 5/1995 Willey
5,416,593 A 5/1995 Cercruysse
5,458,075 A 10/1995 Tice et al.
5,461,996 A 10/1995 Kaju
5,480,085 A 1/1996 Smithe et al.
5,484,639 A 1/1996 Woodall et al.
5,491,372 A 2/1996 Erhart
5,495,815 A 3/1996 Bagnall
5,499,588 A 3/1996 Card et al.
5,501,250 A 3/1996 Edwards et al.
5,503,096 A 4/1996 Willey
5,509,364 A 4/1996 Bardsley
5,513,586 A 5/1996 Neely et al.
5,526,760 A 6/1996 Ok
5,529,002 A 6/1996 Piller
5,544,605 A 8/1996 Frost
5,549,064 A 8/1996 Padgett, III
5,557,154 A 9/1996 Erhart
5,562,056 A 10/1996 Christman, Jr.
5,566,629 A 10/1996 Satterfield
5,566,630 A 10/1996 Burgess et al.
5,575,228 A 11/1996 Padgett, III et al.
5,588,383 A 12/1996 Davis et al.
5,622,126 A 4/1997 Card et al.
5,653,184 A 8/1997 Bardsley
5,662,054 A 9/1997 Bardsley
5,706,744 A 1/1998 Card et al.
5,706,745 A 1/1998 Neely et al.
5,738,030 A 4/1998 Ok
5,743,200 A 4/1998 Miller et al.
5,743,201 A 4/1998 Card et al.
5,794,551 A 8/1998 Morrison et al.
5,806,446 A 9/1998 Morrison et al.
5,809,917 A 9/1998 McGowan et al.
5,896,821 A 4/1999 Neely et al.
5,899,152 A 5/1999 Bardsley et al.
5,954,003 A 9/1999 Beyer et al.
5,974,991 A 11/1999 Bardsley
5,979,344 A 11/1999 Christman, Jr.
5,983,815 A 11/1999 Card
5,989,368 A 11/1999 Tillander et al.
6,009,818 A 1/2000 Card et al.
6,155,187 A 12/2000 Bennett et al.
6,196,145 B1 3/2001 Burgess
6,202,580 B1 3/2001 Samilo
6,213,036 B1 4/2001 Slattery
6,224,203 B1 5/2001 Wotton et al.
6,228,460 B1 5/2001 Hamilton et al.
6,230,638 B1 5/2001 Ownbey et al.
6,244,203 B1 6/2001 Morgante et al.
6,263,811 B1 7/2001 Crossley
6,273,011 B1 8/2001 Amos
6,283,053 B1 9/2001 Morgante et al.
6,293,211 B1 9/2001 Samilo
6,401,639 B1 6/2002 Samilo
6,439,141 B2 8/2002 Morgante et al.
6,446,566 B1 9/2002 Bennett et al.
6,502,521 B2 1/2003 Morgante et al.
6,508,185 B1 1/2003 Morgante et al.
6,516,734 B1 2/2003 Morgante et al.
6,550,407 B1 4/2003 Frost et al.
6,651,571 B2 11/2003 Bennett et al.
6,729,254 B2 5/2004 Mamiya
6,758,154 B2 7/2004 Johnston
6,776,109 B2 8/2004 Segars et al.
6,782,838 B1 8/2004 Segars et al.
6,807,917 B1 10/2004 Christman et al.
6,823,900 B2 11/2004 Wildeman et al.
6,827,030 B2 12/2004 Hicks
6,834,601 B2 12/2004 Card et al.
6,834,602 B1 12/2004 Hall
6,877,447 B2 4/2005 Frost et al.
6,877,449 B2 4/2005 Morgante et al.
6,895,877 B1 5/2005 Weiner
6,902,789 B2 6/2005 Funasako
6,945,184 B2 9/2005 Frost et al.
6,971,326 B1 12/2005 Clarke et al.
7,007,617 B2 3/2006 Johnston
7,033,661 B2 4/2006 Whitten et al.
7,083,841 B2 8/2006 Oakey et al.
7,089,874 B2 8/2006 Morgante et al.
7,096,806 B2 8/2006 Card et al.
7,130,711 B2 10/2006 Dabrowa et al.
7,216,598 B1 5/2007 Christman, Jr.
7,222,576 B2 5/2007 Kilgore
7,237,497 B2 7/2007 Johnston
7,243,513 B2 7/2007 Kohlman
7,264,854 B2 9/2007 Stroppiana
7,296,524 B2 11/2007 Beverly
7,333,877 B2 2/2008 Dabrowa et al.
7,347,151 B1 3/2008 Johnston et al.
RE40,194 E 4/2008 Slattery
7,350,443 B2 4/2008 Oakey et al.
7,356,453 B2 4/2008 Gould
7,426,895 B2 9/2008 Smith et al.

(56) References Cited

U.S. PATENT DOCUMENTS

| | | | |
|---|---|---|---|
| 7,431,974 | B2 | 10/2008 | Lovelady et al. |
| 7,438,007 | B1 | 10/2008 | Hall |
| 7,490,566 | B2 | 2/2009 | Hall |
| 7,490,569 | B2 | 2/2009 | Whitten et al. |
| 7,634,326 | B2 | 12/2009 | Christman, Jr. et al. |
| 7,682,686 | B2 | 3/2010 | Curro et al. |
| 7,685,952 | B2 | 3/2010 | Frost et al. |
| 7,707,953 | B2 | 5/2010 | Hillenbrand et al. |
| 7,717,049 | B2 | 5/2010 | Hillenbrand et al. |
| 7,717,051 | B1 | 5/2010 | Hall et al. |
| 7,814,850 | B2 | 10/2010 | Bearden |
| 8,082,861 | B2 | 12/2011 | Lovelady et al. |
| 8,127,698 | B1 | 3/2012 | Ingram |
| 8,141,505 | B2 | 3/2012 | Hall et al. |
| 8,240,263 | B1 | 8/2012 | Frost et al. |
| 8,359,989 | B2 | 1/2013 | Hall et al. |
| 8,776,703 | B2 | 7/2014 | Hall et al. |
| 9,399,832 | B2 | 7/2016 | Hall et al. |
| 9,410,276 | B2 | 8/2016 | Hall et al. |
| 2002/0037388 | A1 | 3/2002 | Morgante et al. |
| 2002/0067483 | A1 | 6/2002 | Lacovara |
| 2003/0164130 | A1 | 9/2003 | Morgante et al. |
| 2004/0025767 | A1 | 2/2004 | Card et al. |
| 2004/0187268 | A1 | 9/2004 | Johnston |
| 2004/0253409 | A1 | 12/2004 | Whitten et al. |
| 2005/0056197 | A1 | 3/2005 | Card et al. |
| 2005/0109253 | A1 | 5/2005 | Johnston |
| 2005/0188905 | A1 | 9/2005 | Dabrawa et al. |
| 2005/0204975 | A1 | 9/2005 | Card et al. |
| 2006/0272564 | A1 | 12/2006 | Card et al. |
| 2007/0272137 | A1 | 11/2007 | Christman et al. |
| 2008/0134949 | A1 | 6/2008 | Bearden |
| 2009/0205547 | A1 | 8/2009 | Hall |
| 2014/0283724 | A1 | 9/2014 | Frost et al. |

FOREIGN PATENT DOCUMENTS

| | | |
|---|---|---|
| GB | 853 943 | 11/1960 |
| GB | 859 761 | 1/1961 |
| GB | 920 023 | 3/1963 |
| GB | 1 039 857 | 8/1966 |
| GB | 2 050 447 | 7/1981 |
| GB | 2 115 025 | 9/1983 |
| GB | 2 246 371 | 1/1992 |
| GB | 2 319 786 | 6/1998 |
| GB | 2 392 172 | 2/2004 |
| GB | 2 385 604 | 3/2005 |
| GB | 2 446 371 | 8/2008 |
| JP | 03-294561 | 12/1991 |
| JP | 6-83787 | 11/1994 |
| JP | 08-003859 | 1/1996 |
| JP | 2005-240199 | 9/2005 |
| JP | 2006-524753 | 11/2006 |
| WO | WO 84/00388 | 2/1984 |
| WO | WO 94/28225 | 5/1994 |
| WO | WO 96/12843 | 5/1996 |
| WO | WO 01/59195 | 8/2001 |
| WO | WO 2004/057084 | 7/2004 |
| WO | WO 2006/076558 | 7/2006 |

OTHER PUBLICATIONS

Extended European Search Report for related European application No. 14167507.4-1710/2775023, dated Sep. 11, 2015.

Office Action dated Dec. 27, 2013 for related Japanese Application No. 2013-024279.

Search report for related application, PCT International Search Report, application No. PCT/US2008/080946, filed Oct. 23, 2008.

CAM with Encore DMC, Operator's Manual, Version 3.6, Tuftco Corporation, Copyright 1995, Chattanooga, TN.

Command Performance 200 Instruction Manual, Version 3.12, CMC #801107-01, Card-Monroe Corp., Copyright 1985-1994, Chattanooga, TN.

Tuft Program, Version 1.20, Nov. 1993, NedGraphics BV.

CMC Yarntronics Brochure, http://www.cardmonroe.com/Products/Yarntronics/yarnt.htm, printed Feb. 21, 2002.

Automation Comes to Paris, Carpet & Rug, Inc., 1987.

Moving Toward Total Automation, Carpet & Rug Industry, Dec. 1990.

International Search Report and Written Opinion for Application No. PCT/US2008/081527, dated Feb. 18, 2009.

Search report for related application, International Search Report, application No. PCT/US2009/049501, filed Feb. 7, 2009.

Extended European Search Report dated Aug. 7, 2009, European Patent Application No. 09 152 848 .9 (Pub No. 2 100 994).

European Official Communication dated Mar. 25, 2010, European Patent Application No. 09 152 848 .9 (Pub No. 2 100 994).

European Notice of Intention to Grant a European Patent dated Dec. 13, 2010, European Patent Application No. 09 152 848 9 (Pub No. 2 100 994).

Response submitted Sep. 30, 2010, to the Communication dated Mar. 25, 2010, European Patent Application No. 09 152 848 9 (Pub No. 2 100 994).

Carpet Design, Technology Are on a Roll, Kathryn Sellers, Carpet & Rug Institute, .COPYRGT.2001, Textile World, vol. 151, No. 3.

NedGraphics, Aug. 26, 1994, Carpet & Floor Coverings Review.

Simple or sophisticated: Computers: CAD, Sep. 11, 1992, Carpet & Floor Coverings Review, pp. 32-34.

Partial European Search Report for EP 14 16 7507 dated Mar. 18, 2015.

Partial European Search Report for EP 09 15 2848 dated Aug. 7, 2009.

Cobble, Blackburn Ltd., Servo Systems Operation Manual—New Software Version—Apr. 1999, Issue 2.11A—pp. 1-16.

Cobble, ST (with Graphical User Interface) Tufting Machine—Operator's Handbook—Revision 1.5, Software Build 43—Issue Date: Sep. 2003.

Office Action for JP 2013-211615, dated Aug. 22, 2014, with English translation.

Defendant Tuftco Corp.'s Motion to Stay Case Pending Determination of Inter Partes Review Proceedings, filed Dec. 29, 2014, *Card-Monroe Corp.*, v. *Tuftco Corp.*, E.D. Tenn., Case No. 1:14-cv-292.

Defendant Tuftco Corp.'s Memorandum in Support of Motion to Stay Case Pending Determination of Inter Partes Review Proceedings, filed Dec. 29, 2014, *Card-Monroe Corp.*, v. *Tuftco Corp.*, E.D. Tenn., Case No. 1:14-cv-292.

Plaintiff's Motion to Dismiss Defendant's Amended Counterclaims and to Strike Portions of Defendant's Affirmative Defenses, filed Jan. 22, 2015, *Card-Monroe Corp.*, v. *Tuftco Corp.*, E.D. Tenn., Case No. 1:14-cv-292.

Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit A to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit B to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit C to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

Exhibit D to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.

(56) References Cited

OTHER PUBLICATIONS

Exhibit E to Plaintiffs Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.
Exhibit F to Plaintiff's Memorandum of Law in Support of Motion to Dismiss Defendant's Amended Counterclaims and to Strike Portions of Defendant's Affirmative Defenses, Filed Jan. 22, 2015, *Card-Monroe Corp.*, v. *Tuftco Corp.*, E.D. Tenn., Case No. 1:14-cv-292.
Plaintiff's Response in Opposition to Defendant's Motion to Stay Case Pending Determination of Inter Partes Review Proceeding, Filed Jan. 22, 2015, *Card-Monroe Corp.*, v. *Tuftco Corp.*, Ed. Tenn., Case No. 1:14-cv-292.
Exhibit A to Plaintiff's Response in Opposition to Defendant's Motion to Stay Case Pending Determination of Inter Partes Review Proceeding, Filed Jan. 22, 2015, *Card-Monroe Corp.*, v. *Tuftco Corp.*, E.D. Tenn., Case No. 1:14-cv-292.
Exhibit B to Plaintiff's Response in Opposition to Defendant's Motion to Stay Case Pending Determination of Inter Partes Review Proceeding, Filed Jan. 22, 2015, *Card-Monroe Corp.*, v. *Tuftco Corp.*, E.D. Tenn., Case No. 1:14-cv-292.
Exhibit C to Plaintiff's Response in Opposition to Defendant's Motion to Stay Case Pending Determination of Inter Partes Review Proceeding, Filed Jan. 22, 2015, *Card-Monroe Corp.*, v. *Tuftco Corp.*, E.D. Tenn., Case No. 1:14-cv-292.
Exhibit D to Plaintiff's Response in Opposition to Defendant's Motion to Stay Case Pending Determination of Inter Partes Review Proceeding, Filed Jan. 22, 2015, *Card-Monroe Corp.*, v. *Tuftco Corp.*, E.D. Tenn., Case No. 1:14-cv-292.
Exhibit E to Plaintiff's Response in Opposition to Defendant's Motion to Stay Case Pending Determination of Inter Partes Review Proceeding, Filed Jan. 22, 2015, *Card-Monroe Corp.*, v. *Tuftco Corp.*, E.D. Tenn., Case No. 1:14-cv-292.
Order, Filed Jan. 23, 2015, *Card-Monroe Corp.*, v. *Tuftco Corp.*, E.D. Tenn., Case No. 1:14-cv-292.
Plaintiff's Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit A to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit B to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit C to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit D to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit E to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Exhibit F to Plaintiff's Memorandum of Law in Support of Motion to Dismiss Defendant's Amended Counterclaims and to Strike Portions of Defendant's Affirmative Defenses, Filed Jan. 23, 2015, *Card-Monroe Corp.*, v. *Tuftco Corp.*, E.D. Tenn., Case No. 1:14-cv-292.
Defendant Tufco Corp.'s Reply in Support of Motion to Stay Case Pending Determination of Inter Partes Review Proceedings, Filed Jan. 29, 2015, *Card-Monroe Corp.*, v. *Tuftco Corp.*, E.D. Tenn., Case No. 1:14-cv-292.
Defendant Tuftco's Response Brief to Plaintiff Card-Monroe's Motion to Dismiss and Motion to Strike, Filed Feb. 16, 2015, *Card-Monroe Corp.*, v. *Tuftco Corp.*, E.D. Tenn., Case No. 1:14-cv-292.
Exhibit A to Defendant Tuftco's Response Brief to Plaintiff Card-Monroe's Motion to Dismiss and Motion to Strike, Filed Feb. 16, 2015, *Card-Monroe Corp.*, v. *Tuftco Corp.*, E.D. Tenn., Case No. 1:14-cv-292.
Exhibit B to Defendant Tuftco's Response Brief to Plaintiff Card-Monroe's Motion to Dismiss and Motion to Strike, Filed Feb. 16, 2015, *Card-Monroe Corp.*, v. *Tuftco Corp.*, E.D. Tenn., Case No. 1:14-cv-292.
Exhibit C to Defendant Tuftco's Response Brief to Plaintiff Card-Monroe's Motion to Dismiss and Motion to Strike, Filed Feb. 16, 2015, *Card-Monroe Corp.*, v. *Tuftco Corp.*, E.D. Tenn., Case No. 1:14-cv-292.
Order, Filed Feb. 19, 2015, *Card-Monroe Corp.*, v. *Tuftco Corp.*, E.D. Tenn., Case No. 1:14-cv-292.
Plaintiff's Reply Memorandum of Law in Support of Motion to Dismiss Defendant's Amended Counterclaims and to Strike Portions of Defendant's Affirmative Defenses, Field Feb. 26, 2015, *Card-Monroe Corp.*, v. *Tuftco Corp.*, E.D. Tenn., Case No. 1:14-cv-292.
Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit A to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit B to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit C to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit D to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit E to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit F to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit G to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit H to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
Exhibit I to Defendant Tuftco Corp.'s Initial Invalidity and Non-Infringement Contentions, Served Apr. 6, 2015, *Card-Monroe Corp.*, v. *Tuftco Corp.*, E.D. Tenn., Case No. 1:14-cv-292.
English translation of Japanese Office Action dated Mar. 4, 2013, for related application No. JP2009-032036.
Decision Denying Institution of Inter Partes Review entered Jul. 22, 2015.
Communication re: Notice of Opposition (and Exhibits included therewith) filed Mar. 12, 2015 against EP2321454.
Japanese Office Action for related Japanese Application No. 2011-51516872, dated Dec. 3, 2012—with Translation.
Defendant's Opening Claim Construction Brief.
Plaintiff's Opening Claim Construction Brief.
Exhibit J—Lexmark Glossary—CMC Claim Construction Brief.

(56) References Cited

OTHER PUBLICATIONS

Exhibit L—Declaration of Steven Berger—CMC Claim Construction Brief.
Plaintiffs Responsive Claim Construction Brief.
Defendant's Responsive Claim Construction Brief.
EPO—Response to Opposition—EP Patent 2 321 454.
Third Office Action—Chinese Text—CN 201210371253.0.
English translation of the Chinese Office Action—CN 201210371253.0.
Defendant Tuftco Corp.'s Answer and Amended Counterclaim, filed Jan. 8, 2015, in matter of *Card-Monroe Corp*, Plaintiff. v. *Tuftco Corp.*, Defendant—Case No. 1:14-cv-292, before Judge Mattice, Magistrate Judge Carter.
Plaintiff's Memorandum of Law in Support of Motion to Dismiss Defendant's Counterclaims and to Strike Defendant's Fourth Through Seventh and Ninth Affirmative Defenses, filed Dec. 15, 2014, in matter of *Card-Monroe Corp*, Plaintiff. v. *Tuftco Corp.*, Defendant—Case No. 1:14-cv-292, before Judge Mattice, Magistrate Judge Carter.
Defendant Tuftco's Response Brief to Plaintiff Card-Monroe's Motion to Dismiss and Motion to Strike, filed Jan. 15, 2015, in matter of *Card-Monroe Corp*, Plaintiff. v. *Tuftco Corp.*, Defendant—Case No. 1:14-cv-292, before Judge Mattice, Magistrate Judge Carter.
Petition for Inter Partes Review Under 35 USC .sctn..sctn. 311-319 and CFR .sctn. 42.100 et seq, filed in Patent Trial and Appeal Board in the matter of *Tuftco Corp.* v. *Card-Monroe Corp.* on Dec. 24, 2014, Inter Partes Review No. IPR2015-00505.
Declaration of Ian Slattery filed in connection with Inter Partes Review No. IPR2015-00505.
Cobble Tufting Machine Company, Inc. ColorTec Operating and Maintenance Manual Servotec Software Version 3.10.xx Apr. 2005.
Spare Parts Manual ColorTec, dated May 8, 1998.
Windows PCCI Operator's Manual, Version 1.0, dated Mar. 13, 1998.
Defendant Tuftco Corp.'s Answer and Counterclaim, filed Nov. 24, 2014, in matter of *Card-Monroe Corp*, Plaintiff. v. *Tuftco Corp.*, Defendant—Case No. 1:14-cv-292, before Judge Mattice, Magistrate Judge Carter.
Super Graphics Product Brochure, Tuftco Corp., Tufco's Computer Design System, Chattanooga, TN.
CMC's Yarn Feed/Stitch Compensation System Product Brochure, Card-Monroe Corp., Chattanooga, TN.
MTInnovation Patterning Systems, Modern Techniques, Inc., Ringgold, GA.
Zieseniss Tufting Machine Operation Manual, Zieseniss Tufting-Textilmaschinen GmbH, Germany.
Control System for Tufting Machines, Tuftco Corp., Chattanooga, TN.
Plaintiff's First Amended Complaint, filed Sep. 21, 2015, *Card-Monroe Corp.* v. *Tuftco Corp.*, E.D. Tenn., Case No. 1:14-cv-292.
Exhibit A to Plaintiff's First Amended Complaint, filed Sep. 21, 2015, *Card-Monroe Corp.* v. *Tuftco Corp.*, E.D. Tenn., Case No. 1:14-cv-292.
Exhibit B to Plaintiff's First Amended Complaint, filed Sep. 21, 2015, *Card-Monroe Corp.* v. *Tuftco Corp.*, E.D. Tenn., Case No. 1:14-cv-292.
Exhibit C to Plaintiff's First Amended Complaint, filed Sep. 21, 2015, *Card-Monroe Corp.* v. *Tuftco Corp.*, E.D. Tenn., Case No. 1:14-cv-292.
Defendant Tuftco Corp.'s Answer to First amended Complaint and Tuftco's Amended Counterclaim, filed Nov. 5, 2015, *Card-Monroe Corp.* v. *Tuftco Corp.*, E.D. Tenn., Case No. 1:14-cv-292.
Exhibit A to Defendant Tuftco Corp.'s Answer to First amended Complaint and Tuftco's Amended Counterclaim, filed Nov. 5, 2015, *Card-Monroe Corp.* v. *Tuftco Corp.*, E.D. Tenn., Case No. 1:14-cv-292.
Exhibit B to Defendant Tuftco Corp.'s Answer to First amended Complaint and Tuftco's Amended Counterclaim, filed Nov. 5, 2015, *Card-Monroe Corp.* v. *Tuftco Corp.*, E.D. Tenn., Case No. 1:14-cv-292.
Plaintiff Card-Monroe Corp.'s Answer to Amended Counterclaim and Affirmative Defenses, filed Nov. 19, 2015, *Card-Monroe Corp.* v. *Tuftco Corp.*, E.D. Tenn., Case No. 1:14-cv-292.
Exhibit A to Plaintiff Card-Monroe Corp.'s Answer to Amended Counterclaim and Affirmative Defenses, filed Nov. 19, 2015, *Card-Monroe Corp.* v. *Tuftco Corp.*, E.D. Tenn., Case No. 1:14-cv-292.
Plaintiff's Opening Claim Construction Brief, filed Feb. 22, 2016, *Card-Monroe Corp.* v. *Tuftco Corp.*, E.D. Tenn., Case No. 1:14-cv-292.
Exhibit A to Plaintiff's Opening Claim Construction Brief, filed Feb. 22, 2016, *Card-Monroe Corp.* v. *Tuftco Corp.*, E.D. Tenn., Case No. 1:14-cv-292.
Exhibit B to Plaintiff's Opening Claim Construction Brief, filed Feb. 22, 2016, *Card-Monroe Corp.* v. *Tuftco Corp.*, E.D. Tenn., Case No. 1:14-cv-292.
Exhibit C to Plaintiff's Opening Claim Construction Brief, filed Feb. 22, 2016, *Card-Monroe Corp.* v. *Tuftco Corp.*, E.D. Tenn., Case No. 1:14-cv-292.
Exhibit D to Plaintiff's Opening Claim Construction Brief, filed Feb. 22, 2016, *Card-Monroe Corp.* v. *Tuftco Corp.*, E.D. Tenn., Case No. 1:14-cv-292.
Exhibit E to Plaintiff's Opening Claim Construction Brief, filed Feb. 22, 2016, *Card-Monroe Corp.* v. *Tuftco Corp.*, E.D. Tenn., Case No. 1:14-cv-292.
Exhibit F to Plaintiff's Opening Claim Construction Brief, filed Feb. 22, 2016, *Card-Monroe Corp.* v. *Tuftco Corp.*, E.D. Tenn., Case No. 1:14-cv-292.
Exhibit G to Plaintiff's Opening Claim Construction Brief, filed Feb. 22, 2016, *Card-Monroe Corp.* v. *Tuftco Corp.*, E.D. Tenn., Case No. 1:14-cv-292.
Exhibit H to Plaintiff's Opening Claim Construction Brief, filed Feb. 22, 2016, *Card-Monroe Corp.* v. *Tuftco Corp.*, E.D. Tenn., Case No. 1:14-cv-292.
Exhibit I to Plaintiff's Opening Claim Construction Brief, filed Feb. 22, 2016, *Card-Monroe Corp.* v. *Tuftco Corp.*, E.D. Tenn., Case No. 1:14-cv-292.
Exhibit J to Plaintiff's Opening Claim Construction Brief, filed Feb. 22, 2016, *Card-Monroe Corp.* v. *Tuftco Corp.*, E.D. Tenn., Case No. 1:14-cv-292.
Exhibit K to Plaintiff's Opening Claim Construction Brief, filed Feb. 22, 2016, *Card-Monroe Corp.* v. *Tuftco Corp.*, E.D. Tenn., Case No. 1:14-cv-292.
Defendant's Opening Claim Construction Brief, filed Feb. 22, 2016, *Card-Monroe Corp.* v. *Tuftco Corp.*, E.D. Tenn., Case No. 1:14-cv-292.
Exhibit A to Defendant's Opening Claim Construction Brief, filed Feb. 22, 2016, *Card-Monroe Corp.* v. *Tuftco Corp.*, E.D. Tenn., Case No. 1:14-cv-292.
Appendix A to Defendant's Opening Claim Construction Brief, filed Feb. 22, 2016, *Card-Monroe Corp.* v. *Tuftco Corp.*, E.D. Tenn., Case No. 1:14-cv-292.
Plaintiff's Notice of Filing Public Exhibits in Support of Plaintiff's Responsive Claim Construction Brief, filed Mar. 7, 2016, *Card-Monroe Corp.* v. *Tuftco Corp.*, E.D. Tenn., Case No. 1:14-cv-292.
Exhibit C to Plaintiff's Notice of Filing Public Exhibits in Support of Plaintiff's Responsive Claim Construction Brief, filed Mar. 7, 2016, *Card-Monroe Corp.* v. *Tuftco Corp.*, E.D. Tenn., Case No. 1:14-cv-292.
Exhibit D to Plaintiff's Notice of Filing Public Exhibits in Support of Plaintiff's Responsive Claim Construction Brief, filed Mar. 7, 2016, *Card-Monroe Corp.* v. *Tuftco Corp.*, E.D. Tenn., Case No. 1:14-cv-292.
Exhibit F to Plaintiff's Notice of Filing Public Exhibits in Support of Plaintiff's Responsive Claim Construction Brief, filed Mar. 7, 2016, *Card-Monroe Corp.* v. *Tuftco Corp.*, E.D. Tenn., Case No. 1:14-cv-292.

(56) References Cited

OTHER PUBLICATIONS

Exhibit J to Plaintiff's Notice of Filing Public Exhibits in Support of Plaintiff's Responsive Claim Construction Brief, filed Mar. 7, 2016, *Card-Monroe Corp.* v. *Tuftco Corp.*, E.D. Tenn., Case No. 1:14-cv-292.
Defendant's Responsive Claim Construction Brief, filed Mar. 7, 2016, *Card-Monroe Corp.* v. *Tuftco Corp.*, E.D. Tenn., Case No. 1:14-cv-292.
Plaintiff's Responsive Claim Construction Brief, filed Mar. 25, 2016, *Card-Monroe Corp.* v. *Tuftco Corp.*, E.D. Tenn., Case No. 1:14-cv-292.
Exhibit A to Plaintiff's Responsive Claim Construction Brief, filed Mar. 25, 2016, *Card-Monroe Corp.* v. *Tuftco Corp.*, E.D. Tenn., Case No. 1:14-cv-292.
Exhibit C to Plaintiff's Responsive Claim Construction Brief, filed Mar. 25, 2016, *Card-Monroe Corp.* v. *Tuftco Corp.*, E.D. Tenn., Case No. 1:14-cv-292.
Exhibit D to Plaintiff's Responsive Claim Construction Brief, filed Mar. 25, 2016, *Card-Monroe Corp.* v. *Tuftco Corp.*, E.D. Tenn., Case No. 1:14-cv-292.
Exhibit E to Plaintiff's Responsive Claim Construction Brief, filed Mar. 25, 2016, *Card-Monroe Corp.* v. *Tuftco Corp.*, E.D. Tenn., Case No. 1:14-cv-292.
Exhibit F to Plaintiff's Responsive Claim Construction Brief, filed Mar. 25, 2016, *Card-Monroe Corp.* v. *Tuftco Corp.*, E.D. Tenn., Case No. 1:14-cv-292.
Exhibit G to Plaintiff's Responsive Claim Construction Brief, filed Mar. 25, 2016, *Card-Monroe Corp.* v. *Tuftco Corp.*, E.D. Tenn., Case No. 1:14-cv-292.
Exhibit H to Plaintiff's Responsive Claim Construction Brief, filed Mar. 25, 2016, *Card-Monroe Corp.* v. *Tuftco Corp.*, E.D. Tenn., Case No. 1:14-cv-292.
Exhibit I to Plaintiff's Responsive Claim Construction Brief, filed Mar. 25, 2016, *Card-Monroe Corp.* v. *Tuftco Corp.*, E.D. Tenn., Case No. 1:14-cv-292.
Exhibit J to Plaintiff's Responsive Claim Construction Brief, filed Mar. 25, 2016, *Card-Monroe Corp.* v. *Tuftco Corp.*, E.D. Tenn., Case No. 1:14-cv-292.
Plaintiff's Reply Claim Construction Brief, filed Apr. 6, 2016, *Card-Monroe Corp.* v. *Tuftco Corp.*, E.D. Tenn., Case No. 1:14-cv-292.
Official Transcription of Proceedings held on Apr. 7, 2016 before The Honorable Travis R. McDonough, filed Apr. 8, 2016, *Card-Monroe Corp.* v. *Tuftco Corp.*, E.D. Tenn., Case No. 1:14-cv-292.
Defendant's Notice of Filing of Declaration of Ian Slattery, filed Apr. 14, 2016, *Card-Monroe Corp.* v. *Tuftco Corp.*, E.D. Tenn., Case No. 1:14-cv-292.
Exhibit 1 to Defendant's Notice of Filing of Declaration of Ian Slattery, filed Apr. 14, 2016, *Card-Monroe Corp.* v. *Tuftco Corp.*, E.D. Tenn., Case No. 1:14-cv-292.
Memorandum Opinion, filed Jun. 9, 2016, *Card-Monroe Corp.* v. *Tuftco Corp.*, E.D. Tenn., Case No. 1:14-cv-292.

THREE COLORS

FOUR COLORS

FIVE COLORS

SIX COLORS

YARN COLOR PLACEMENT SYSTEM

CROSS-REFERENCE TO RELATED APPLICATIONS

This application is a continuation application of prior U.S. Continuation Utility application Ser. No. 14/321,152, filed Jul. 1, 2014, entitled "Yarn Color Placement System," which application is a continuation application of prior U.S. Continuation Utility application Ser. No. 13/422,238, filed Mar. 16, 2012, entitled "Yarn Color Placement System," now issued as U.S. Pat. No. 8,776,703, which application is a continuation application of prior U.S. Utility application Ser. No. 12/122,004, filed May 16, 2008, entitled "Yarn Color Placement System," now issued as U.S. Pat. No. 8,141,505, which application/patent claims the benefit of U.S. Provisional Application No. 61/029,105, filed Feb. 15, 2008, according to the statutes and rules governing provisional patent applications, particularly USC § 119(e)(1) and 37 CFR § 1.78(a)(4) and (a)(5). The entire disclosures of U.S. Utility Patent application Ser. No. 14/321,152, U.S. Utility application ser. No. 13/422,238, U.S. Utility application Ser. No. 12/122,004 and U.S. Provisional Application No. 61/029,105 are incorporated herein by reference as if set forth in their entireties.

FIELD OF THE INVENTION

The present invention generally relates to tufting machines, and in particular, to a system for controlling the feeding and placement of yarns of different colors within a backing material passing through a tufting machine to enable formation of free-flowing patterns within a tufted article.

BACKGROUND OF THE INVENTION

In the tufting of carpets and other, similar articles, there is considerable emphasis placed upon development of new, more eye-catching patterns in order to try to keep up with changing consumer tastes and increased competition in the marketplace. In particular, there has been emphasis over the years on the formation of carpets that replicate the look and feel of fabrics formed on a loom. With the introduction of computer controls for tufting machines such as disclosed in the U.S. Pat. No. 4,867,080, greater precision and variety in designing and producing tufted pattern carpets, as well as enhanced production speeds, have been possible. In addition, computerized design centers have been developed to help designers design and create wider varieties of patterns, with requirements such as yarn feeds, pile heights, etc., being automatically calculated and generated by the design center computer.

Additionally, attempts have been made to develop tufting machines in which a variety of different color yarns can be inserted into a backing material to try to create more free-flowing patterns. For example, specialty machines have been developed that include a moving head that carries a single hollow needle in which the ends of the different color yarns are individually fed to the needle for insertion into the backing material at a selected location. Other machines having multiple needles in a more conventional tufting machine configuration and which move the backing material forwardly and rearwardly to place multiple colors in the backing material also have been developed. A problem exists, however, with such specialty tufting machines for individually placing yarns, in that the production rates of such machines generally are restricted as the yarns are placed individually in the backing material by the single needle or as the backing feed direction is changed. As a consequence, such specialized color patterning machines typically are limited to special applications such as formation of patterned rugs or carpets of limited or reduced sizes.

Accordingly, it can be seen that a need exists for a system and method that addresses these and other related and unrelated problems in the art.

SUMMARY OF THE INVENTION

Briefly described, the present invention generally relates to a yarn color placement system for a tufting machine for use in forming patterned tufted articles, such as carpets, including the formation of substantially free-flowing patterns and/or carpets with a woven or loom formed appearance. The tufting machine with the yarn color placement system of the present invention typically will include a tufting machine control system for controlling the operative elements of this tufting machine, and one or more shifting needle bars having a series of needles spaced therealong. A tufting zone is defined along the reciprocating path of the needles through which a backing material is fed at a programmed or prescribed rate of feeding or desired stitch rate. As the backing material is fed through the tufting zone, the needles are reciprocated into and out of the backing material to form loops of yarns therein.

A shift mechanism is provided for shifting the needle bar(s) transversely across the tufting zone, and multiple shift mechanisms typically will be utilized where the tufting machine includes more than one shifting needle bar. The shift mechanism(s) can include one or more cams, servo motor controlled shifters, or other shifters such as a "Smart-Step" shift mechanism as manufactured by Card-Monroe Corp., which shift the needle bar in accordance with the designed pattern shift steps. The shift steps for the needle bar(s) will be accomplished in accordance with a cam or shift profile calculated or designed into the pattern when the pattern is created, or in accordance with pre-designed or pre-loaded patterns in the tufting machine controller. The cam or shift profile further can be varied depending on the number of colors to be used in the pattern being formed. For example, for three or four colors, a three or four color cam or cam profile can be utilized for shifting each needle bar.

The yarn color placement system further generally will include a pattern yarn feed mechanism or attachment for controlling the feeding of the yarns to their respective needles. The pattern yarn feed pattern mechanism can include various roll, scroll, servo-scroll, single end, or double end yarn feed attachments, such as, for example, a Yarntronics™ or Infinity™ or Infinity IIE™ yarn feed attachment as manufactured by Card-Monroe Corp. Other types of yarn feed control mechanisms also can be used to control the feeding of the yarns to their selected needles according to the programmed pattern instructions so as to pull low or backrob from the backing material those yarns to be hidden in the pattern fields being sewn at that time. The system control of the tufting machine further typically will control the operative functions of the tufting machine, including the operation of the shift mechanism(s) and yarn feed mechanism(s) according to the programmed pattern instructions.

Additionally, a looper or hook assembly including gauge parts such as cut-pile hooks, loop pile loopers, and/or level cut loopers or hooks generally will be provided below the tufting zone in a position so as to engage the needles as the needles penetrate the backing material so as to pick and/or pull loops of yarns therefrom. In one embodiment, a series of the level cut loop loopers are individually controlled by the system control of the tufting machine during each stitch, based on the pattern stitch being formed and shift profile step therefore, so as to be actuated or fired selectively for each stitch according to whether the loops of yarn being formed thereby are to be pulled back or backrobbed, and thus hidden upon the formation of each stitch in the pattern, kept as loop pile tufts, or retained on the level cut loop looper to form a cut pile tuft.

The yarn color placement system according to the principles of the present invention further generally will be operated at increased or denser stitch rates than conventional tufting processes. Typically, the operative or effective stitch rate run by the yarn placement system will be approximately equivalent to a desired or prescribed number of stitches per inch at which the backing material is fed, multiplied by the number of colors being run in the programmed pattern. As a consequence, as the needle bar(s) is shifted during the formation of the pattern stitches, for each color to be taken out or back-robbed and thus hidden in the finished patterned article, the increased number of stitches per inch will provide sufficient enhanced density to the finished patterned tufted article to avoid a missing color or gap being shown or otherwise appearing in the patterned article.

Various objects, features and advantages of the present invention will become apparent to those skilled in the art upon a review of the following detailed description when taken in conjunction with the accompanying drawings.

DETAILED DESCRIPTION OF THE INVENTION

Figure 1:
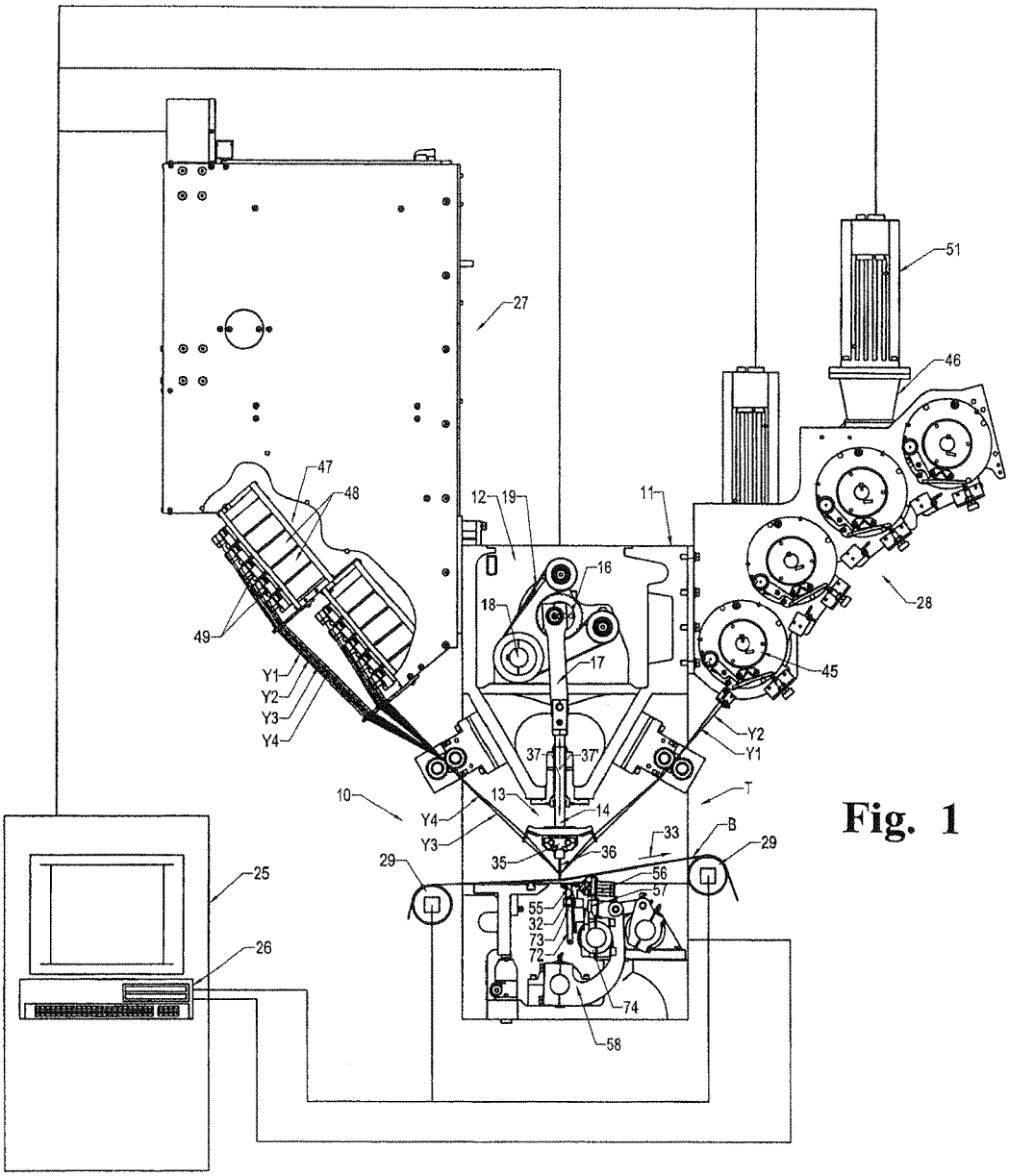
FIG. 1 is a side elevational view of a tufting machine incorporating the yarn color placement system of the present invention.

Referring now to the drawings in which like numerals indicate like parts throughout the several views, in accordance with one example embodiment of the yarn color placement system of the present invention, as generally illustrated in FIGS. 1-5, a tufting machine 10 is provided for controlling placement of yarns Y1-Y4, etc., of different colors at desired locations in a backing material B to form a tufted article having a variety of varying or free-flowing colored pattern effects therein. While four yarns/colors are indicated, it will be understood that more or fewer different color yarns (i.e., two color, three color, five color, six colors, etc., as illustrated in FIGS. 6A-6D) also can be utilized in the yarn color placement system of the present invention.

As generally illustrated in FIG. 1, the tufting machine 10 generally includes a frame 11, including a head portion 12 housing a needle bar drive mechanism 13 and defining a tufting zone T. The needle bar drive mechanism 13 (FIGS. 1, 3 and 4) typically includes a series of push rods 14 connected to a gear box drive 16 or similar mechanism, by connector rods 17. The gear box drive 16 in turn is connected to and driven off a main drive shaft 18 (FIGS. 1 and 4) for the tufting machine by one or more drive belts or drive chains 19, with the main drive shaft 18 itself being driven by a motor, such as a servo motor. Alternatively, the push rods 14 of the needle bar drive mechanism 13 can be directly connected via connector rods 17 to the main drive shaft 18 so as to be driven directly off the main drive shaft to control operation of the main drive shaft motor (not shown).

An encoder additionally can be provided for monitoring the rotation of the main drive shaft and reporting the position of the main drive shaft to a tufting machine control system 25 (FIG. 1). The tufting machine control system 25 generally will comprise a tufting machine control such as a "Command-Performance™" tufting machine control system as manufactured by Card-Monroe Corp. The control system also typically includes a computer/processor or controller 26 that can be programmed with various pattern information and which monitors and controls the operative elements of the tufting machine 10, such as the needle bar drive mechanism 13, yam feed attachments 27/28, backing feed rolls 29, the main drive shaft 18, a needle bar shift mechanism 31 (FIGS. 3 and 4) and a looper or hook assembly 32 mounted beneath the tufting zone T of the tufting machine, as discussed more fully below. The tufting machine control system 25 (FIG. 1) further can receive and execute or store pattern information directly from a design center (not shown) that can be separate and apart from the tufting machine control system, or which can be included as part of the tufting machine control system. In response to such programmed pattern instructions, the tufting machine control system 25 will control the operative elements of the tufting machine 10 in order to form the desired tufted patterns in the backing material B as the backing material is passed through the tufting zone T in the direction of arrow 33 by the backing feed rolls 29.

As indicated in FIGS. 1-5, the needle bar drive mechanism 13 of the tufting machine 10 also will include one or more shiftable needle bars 35 attached to and driven by the push rods 14 and carrying a series of needles 36 arranged in in-line or offset rows spaced transversely along the length of the needle bar and across the tufting zone of the tufting machine. While only a single shifting needle bar 35, with an inline row of needles 36 arranged therealong is shown in the figures, it will be understood by those skilled in the art that additional arrangements of dual shifting needle bars having spaced rows of needles 36 arranged in-line or in a staggered or offset configuration also can be utilized in the tufting machine 10 incorporating the yarn control placement system according to the present invention.

During operation of the needle bar drive mechanism, the needles are reciprocated, as indicated by arrows 37 and 37' (FIG. 2), into and out of the backing material B, carrying the yarns Y1-Y4 so as to insert or place loops of yarn in the backing material for forming loop pile and cut pile tufts 38 in the backing material. Additionally, as illustrated in the embodiments shown in FIGS. 3 and 4, shift mechanism 31 generally will be linked to the needle bar 35 for shifting the needle bar in the direction of arrows 41 and 41', transversely across the tufting zone according to programmed pattern instructions. The shift mechanism 31 can include a Smart Step™ type shifter as manufactured by Card-Monroe Corp., or alternatively can include various other types of shift mechanisms including servo motor or hydraulically controlled shifters, and/or pattern cam shifters as are conventionally used.

Figure 6A:
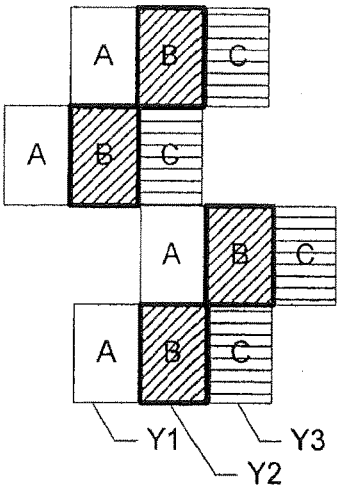
FIGS. 6A-6D are schematic illustrations of example shift/step patterns for tufting patterns having different numbers of colors using the method of the present invention.
Figure 6B:
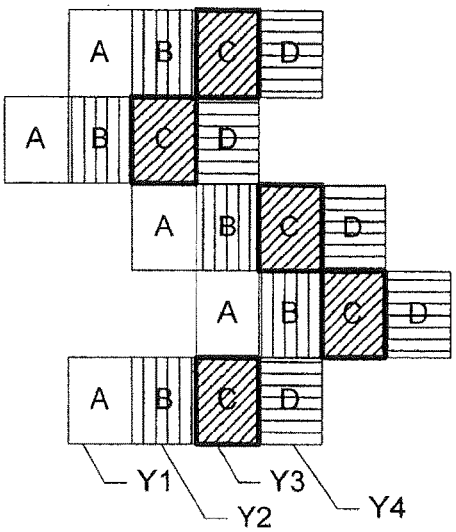
Figure 6C:
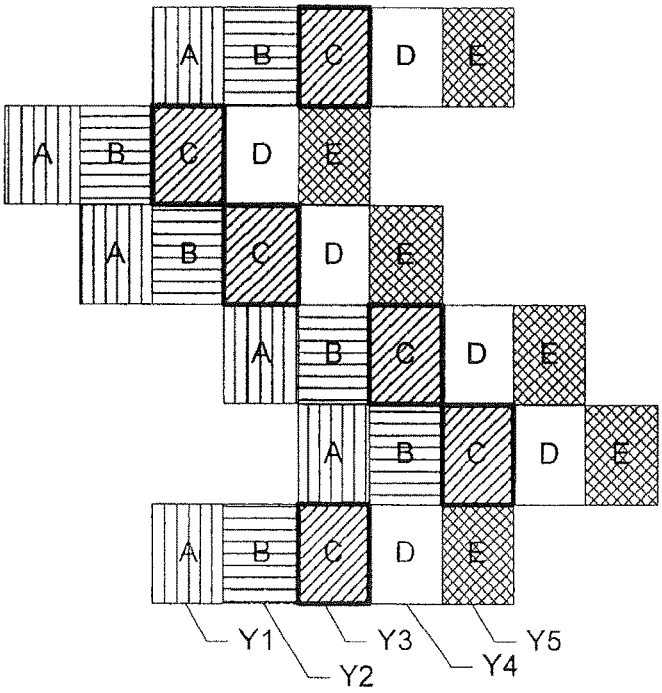
Figure 6D:
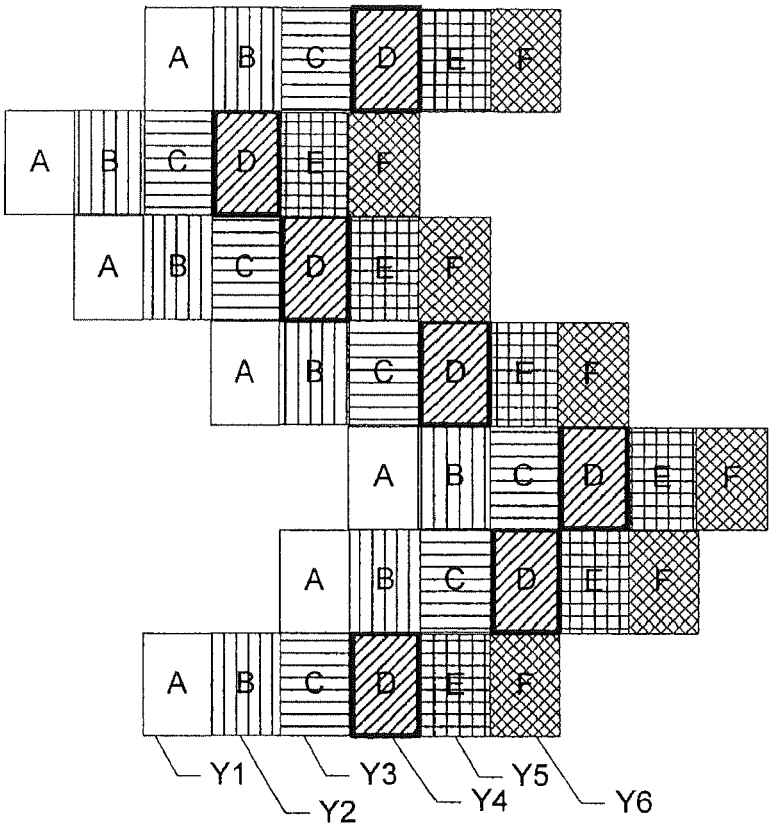

As part of the pattern information/instructions programmed into the tufting machine control system 25 (FIG. 1), there typically will be a cam profile or shift profile of the shift steps calculated for the pattern when it is created, such as at a design center, for controlling the shifting of the needle bar(s) as necessary to form the desired pattern. The pattern shift steps or cam profile further can be varied depending on the number of colors used in the pattern being run. FIGS. 6A-6D illustrate various shift or stepping patterns for the needle bar, reflecting the shifting of the needle bar where three, four, five or six different color yarns are utilized in the pattern, and illustrate single and double step or jump segments followed to avoid oversewing prior sewn tufts. For example, for running a stepping pattern utilizing three different colors of yarns, as indicated in FIG. 6A, an initial step or shift can be made to the right, which would then be followed by a double gauge shift or jump, ending with a single gauge shift. Similarly, for four, five and/or six colors, shown in FIGS. 6B-6D, after an initial shift to the right of a single or double gauge jump, the pattern then shifts back to the left using single and double gauge jumps or shifts in order to avoid sewing over or over-tufting previously sewn tufts. Additionally, while the initial shift or jump is shown as going to the right in FIGS. 6A-6B, it is also possible to start the shift steps to the left. Still further, as the needle bar is shifted, the backing material also is generally fed through the tufting machine at an increased or denser stitch rate to achieve a denser pattern or fill-in of the selected colors for the particular field of the pattern.

In some conventional tufting systems, the stitch rate for tufting patterns run thereby generally has been matched to the gauge of the tufting machine, i.e., for a tenth gauge tufting machine, the stitch rate typically will be approximately ten stitches per inch, while for an eighth gauge machine, the stitch rate will be approximately eight stitches per inch. In the present invention, the operative or effective stitch rate run by the yarn color placement system will be substantially higher, and thus more dense than typical desired stitch rates. Typically, with the yarn color placement system of the invention, this enhanced effective stitch rate will be approximately equivalent to the desired stitch rate multiplied by the number of different colors being run in the pattern. Thus, with yarn color placement system of the present invention, for a tenth gauge machine generally run using a desired stitch rate of approximately ten stitches per inch, if there are three colors in the pattern, the operative or effective stitch rate run by the yarn color placement system will be determined by the desired stitch rate (10 stitches per inch), multiplied by the number of colors (3), for an effective stitch rate of approximately thirty stitches per inch, for four colors, while the operative or effective stitch rate for a four color pattern can be approximately forty stitches per inch, fifty stitches per inch for five colors, etc.

Figure 3:
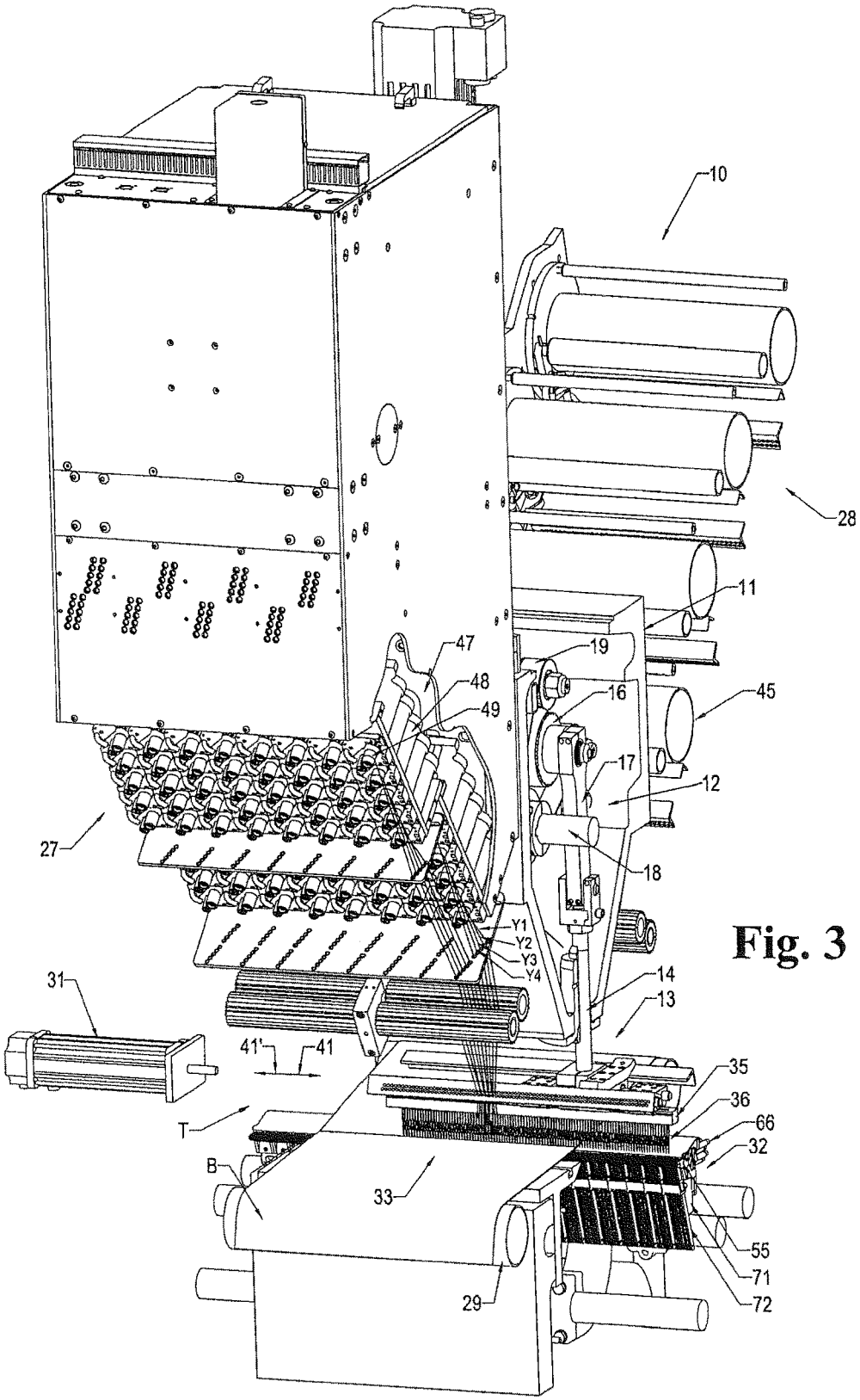
FIG. 3 is a perspective illustration of the yarn color placement system of FIG. 1.
Figure 4:
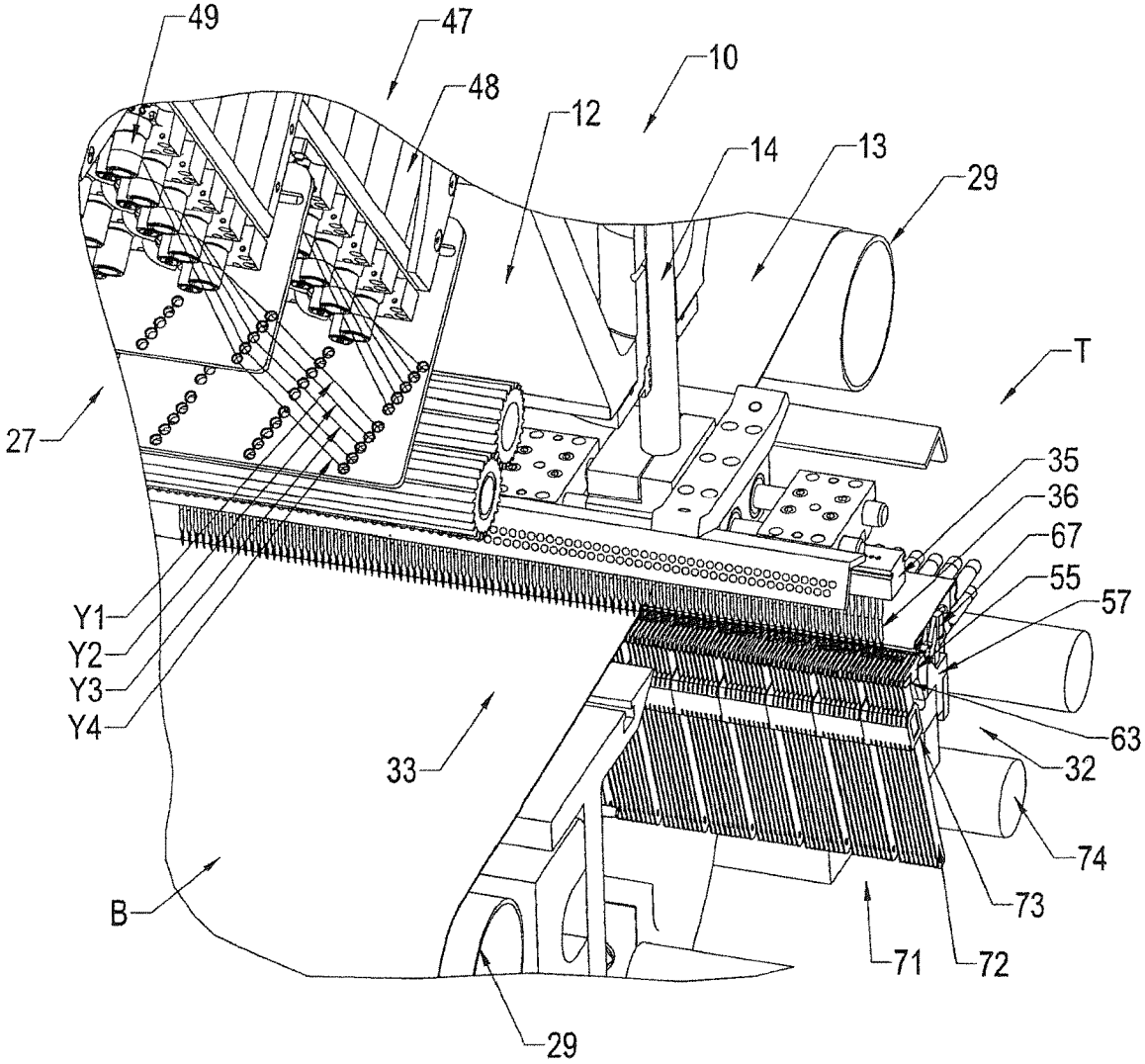
FIG. 4 is a perspective illustration, with parts broken away, illustrating the operation of the level cut loop loopers and shifting of the needle bars in the yarn color placement system of FIG. 1.

As additionally indicated in FIGS. 1, 3 and 4, one or more yarn feed attachments 27 and/or 28 also generally can be mounted to the frame 11 of the tufting machine 10 for controlling the feeding of the different color yams Y1-Y4, etc., to each of the needles during operation of the tufting machine, including pulling back or back-robbing yarns that are to be hidden in particular color fields of the pattern. There are variety of yarn feed attachments that are utilized in the yarn color placement system of the present invention for controlling the feeding of the different color yarns Y1-Y4, etc. to various ones of the needles 36. For example, the pattern yarn feed attachments or mechanisms can include conventional yam feed/drive mechanisms such as roll or scroll pattern attachments, as indicated at 28 in FIGS. 1 and 3, having a series of rolls 45 extending at least partially along the tufting machine and driven by motors 46 under direction of the system control 25 (FIG. 1), for controlling the feeding of all of the yams across the tufting machine to form pattern repeats across the width of the backing material, and including Quick Thread™, Enhanced Graphics™, and/or Multi Pile Height Scroll yarn feed controls/attachments as manufactured by Card-Monroe Corp. Alternatively, other types of pattern yarn feed attachments can be used, as indicated at 27, which have multiple yarn feed drives 47 (FIG. 3), each including a motor 48 and feed rolls 49, for controlling the feeding of specific sets of repeats of yarns to selected needles, including the use of individual yarn feed rolls or drives 48 for controlling the feeding of single yarns or pairs of yarns to each of the needles 36, such as single end/servo-scroll attachments, and/or the Infinity™ and Infinity IIE™ systems as manufactured by Card-Monroe Corp.

For example, U.S. Pat. Nos. 6,009,818; 5,983,815; and 7,096,806 disclose pattern yarn feed mechanisms or attachments for controlling feeding or distribution of yarns to the needles of a tufting machine. U.S. Pat. No. 5,979,344 further discloses a precision drive system for driving various operative elements of the tufting machine. All of these systems can be utilized with the present invention and are incorporated herein by reference in their entireties. Additionally, while in FIG. 1 a roll or scroll-type pattern attachment is shown at 28 as being used in conjunction with a single or double end type yarn feed mechanism 27, it also will be understood by those skilled in the art all of the pattern yarn feed mechanisms 27/28 utilized to control the yarn feed in the yarn color placement system of the present invention can include only single or double end yarn feed controls, or only scroll, roll, or similar attachments, and can be mounted along one or both sides of the tufting machine.

As indicated in FIGS. 1-4, the backing material B is fed through the tufting zone along a feed or path in the direction of arrow 33 by the backing rolls 29 (FIGS. 1 and 2) by the operation of drive motors 51 that are linked to and controlled by the machine control system 25. The backing material B is fed at the effective stitch rate for the pattern being formed by the yarn color placement system of the present invention (i.e., the desired rate multiplied by the number of colors of the pattern), and is engaged by the needles 36 that insert the yarns Y1-Y4 (to form the tufts 38 in the backing material. As the needles penetrate the backing material, they are engaged by the looper/hook assembly 32 so as to form loops of yarns that then can be cut to form cut-pile tufts, or can be remain as loops according to each pattern step. The released loops of yarns can be back-robbed or pulled low or out of the backing by the operation of the pattern yarn feed attachment(s) 27/28 as needed to vary the height of the loops of the additional colored yarns that are not to be shown or visually present in the color field of the pattern being sewn at that step.

Figure 2:
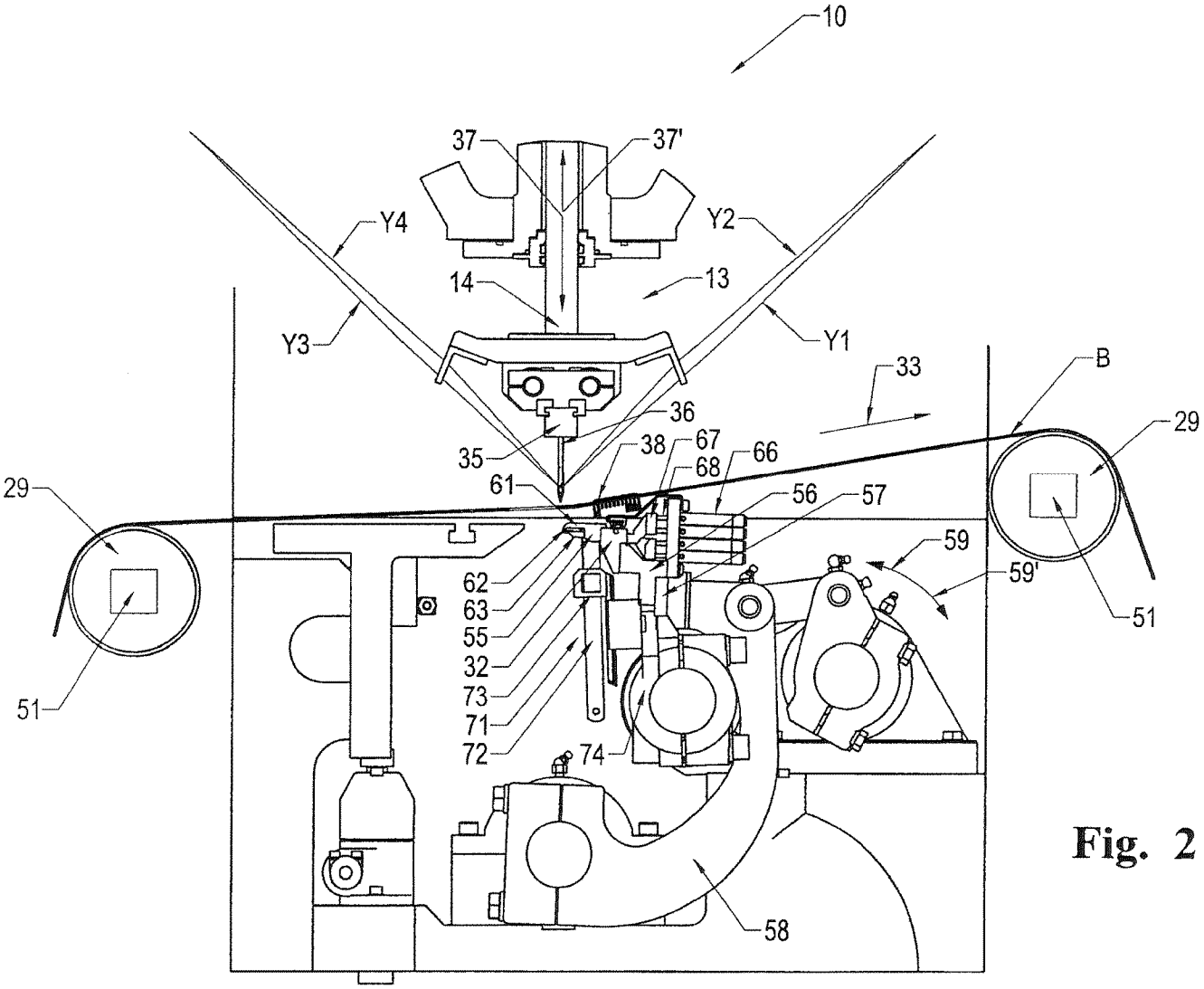
FIG. 2 is a side elevational view of the tufting machine of FIG. 1, illustrating the needles and level cut loopers.

As shown in FIGS. 1 and 2, the looper/hook assembly 32 generally is mounted below the bed and tufting zone T of the tufting machine 10. In one example embodiment of the yam color placement system according to the present invention, the looper/hook assembly 32 generally includes a series of level cut loop loopers 55 (FIG. 2) mounted on a support block or holder 56 that is attached to a hook or looper bar 57 that is itself mounted on a reciprocating drive arm 58. The drive arm 58 reciprocates the level cut loop loopers 55 toward and away from the needles 36 in the direction of arrows 59 and 59', as the needles penetrate the backing material so that the level cut loop loopers engage the needles to pick and pull the loops of yarns therefrom. It also will be understood by those skilled in the art, however, that while the present invention as disclosed herein is for use with level cut loopers or hooks, it also could be possible to utilize loop pile loopers and/or cut pile hooks, as well as combinations of level cut loop loopers, cut pile hooks and/or loop pile loopers in the yarn placement system of the present invention in order to form the desired patterned articles.

As indicated in FIG. 2, each of the level cut loop loopers 55 generally includes a looper body 61, the rear portion of which is received in the support or hook block 56, and a hooked front or bill portion 62 that extends forwardly therefrom. A series of slots (not shown) generally are formed within the support block 56 adjacent each looper body 61, through which clips 63 are slidably received so as to be moveable from a retracted position rearward of the front portion 62 of each looper 55, to an extended position, projecting adjacent or in contact with the front bill portion 62, as indicated in FIG. 2. In its extended position, each clip prevents a loop of yarn engaged by its associated level cut looper 55 from being captured and held behind the hooked front or bill portion 62 and thereafter being cut. Each of the clips generally includes an elongated body typically formed from metal, plastic, composite or other similar material having a first proximal end that is adapted to extend adjacent the front bill portion of each associated level cut looper, and a rear portion (not shown) that extends through the support block 56.

The clips further each are linked to an associated actuator 66 by a connector or gate 67 which itself is connected to one or more output or drive shafts 68 of its associated actuator(s) 66. The actuators 66 are mounted in spaced, vertically offset rows, along an actuator block and generally can include hydraulic or other similar type cylinders or can include servo motors, solenoids or other similar type mechanisms for driving the clips between their extended and retracted positions.

Each connector or gate 67 further includes an actuator connector portion configured to be connected to an output shaft of an actuator, an extension portion extending forwardly from and at an angle with respect to the actuator connector portion along a direction transverse to the axial direction and a slot portion connected to the extension portion and defining a connector slot extending from the extension portion. The connector slot is configured to engage an associated clip 63, with the connector slot further including laterally spaced side walls defining the slot in which the clip is received. Additionally, each connector slot can be about 0.001 inches-0.003 inches greater in width than the width of the clip that is received therein to enable seating of the clips therein while preventing twisting of the clips during movement thereof, as the lateral side walls generally will prevent substantial lateral movement of the clips relative to their connectors and thus will prevent rotation of the clips about the longitudinal axis of the clips.

Figure 5:
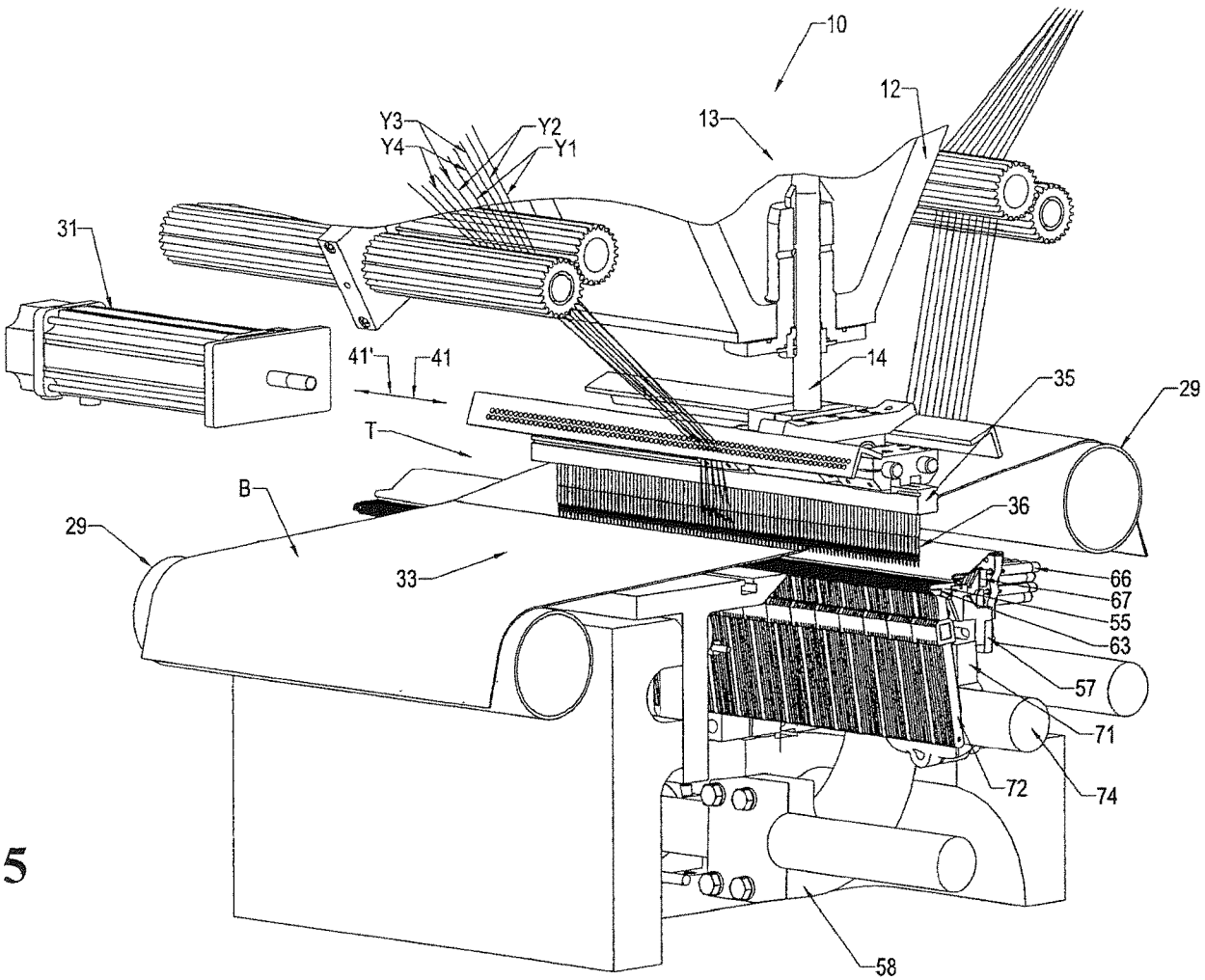
FIG. 5 is a perspective view illustrating a portion of the tufting zone of the tufting machine according to the embodiment of FIG. 1

As further illustrated in FIGS. 2 and 5, a series of knife assemblies 71 typically are provided adjacent the level cut loopers 55 of the hook or looper/hook assembly 32. The knife assembly 71 generally include a knife or cutting blade 72 mounted within the holder 73 connected to a reciprocating drive mechanism 74. The knives are reciprocated into engagement with the level cut loopers 55 so as to cut any loops of yarns selectively captured thereon in order to form the cut pile tufts 38 in the backing material as the backing material B is passed through the tufting zone in the direction of arrow 33, as indicated in FIG. 2.

Figure 7:
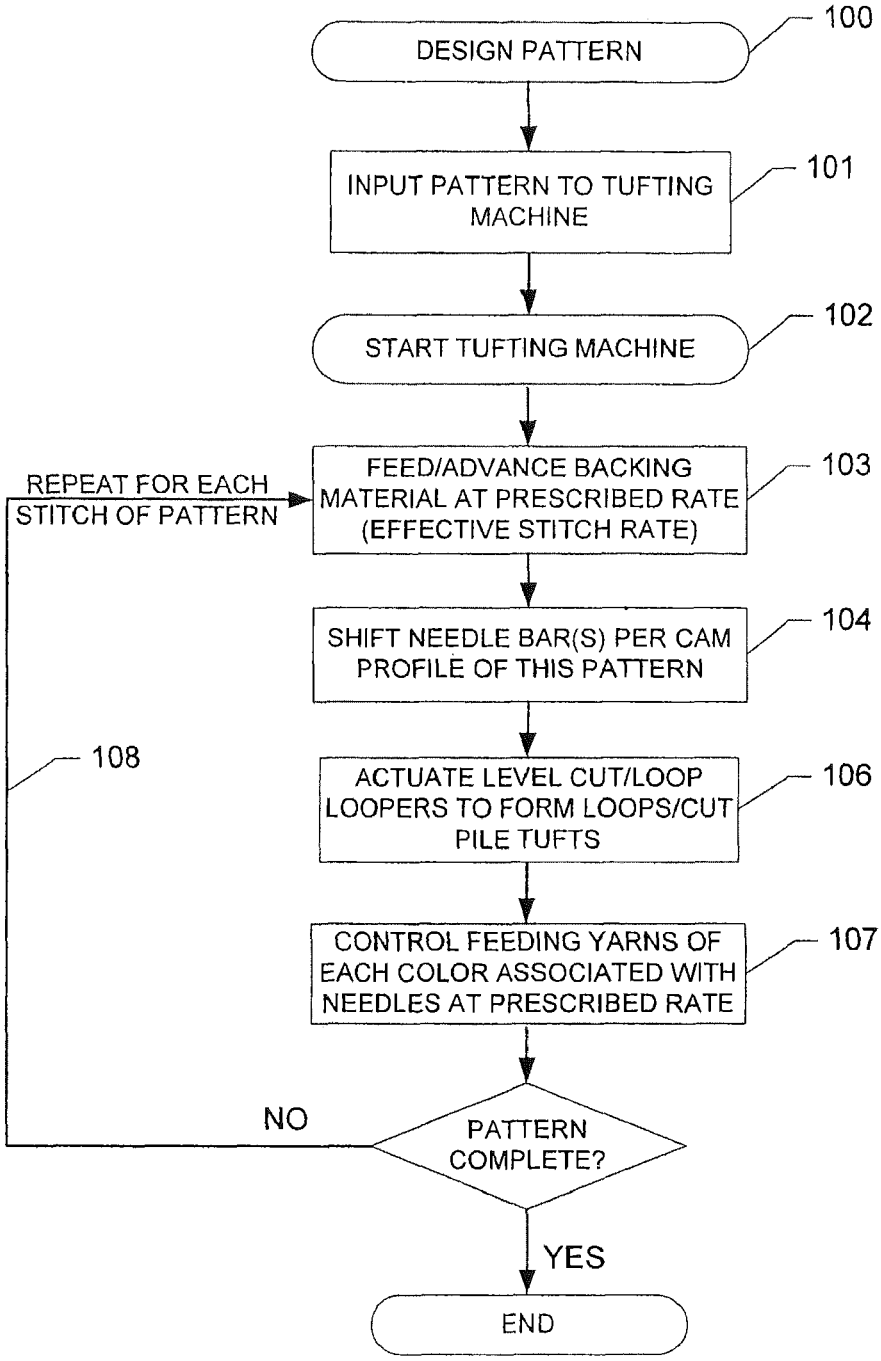
FIG. 7 is a flow diagram illustrating the operation of the yarn color placement system according to the present invention.

FIG. 7 generally illustrates one embodiment of the operation of the yarn color placement system according to the principles of the present invention. As an initial step 100, the pattern generally will be designed, such as at a design center, with various parameters, such as the number of colors, desired stitch rate, and shifts or jumps of the pattern generally inputted or calculated to create the desired pattern, including the use of a variety of different colored yarns. Thereafter, as indicated at step 101, the pattern will be transferred to the tufting machine 10 (FIG. 1) generally by being loaded into the system control 25 for the tufting machine by disk or network connection to the design center. Once the desired pattern(s) has been loaded, the tufting machine will be started, as indicated at 102 (FIG. 7), to start the tufting operation.

As the pattern is sewn, the backing material B (FIG. 2) is fed through the tufting zone T at the prescribed or effective stitch rate, as indicated in block 103 (FIG. 7). As discussed above, this effective stitch rate is substantially increased over conventional stitch rates (i.e., by a factor approximately equivalent to the number of colors being tufted) in order to provide sufficient density for the tufts being formed in the pattern fields to hide those color yarns not to be shown. As indicated at step 104, as the pattern is formed in the backing material, the needle bars are generally shifted per the cam profile or shift profile of the pattern. For example, as indicated in FIGS. 6A-6D, the needle bar will be shifted using a combination of single and/or double jumps or shifts, based on the number of colors being run in the pattern and the area of the pattern field being formed by each specific color. Such a combination of single and double shift jumps or steps will be utilized in order to avoid over-tufting or engaging previously sewn tufts as the needle bar is shifted transversely and the backing material advances at its effective or operative stitch rate. Additionally, as the needles penetrate the backing material, the level cut loop loopers 55 (FIG. 2) of the looper/hook assembly 32 positioned below the tufting zone T, also are reciprocated toward the tufting zone so as to engage and pick or pull loops of yarns from each of the needles.

As indicated in FIG. 7 at step 106, as the level cut loop loopers are being moved into engagement with the needles, they are selectively actuated, as needed to form loops of yarns that either will be released from the level cut loop loopers, or retained thereon for forming cut pile tufts. The level cut loop loopers each will be individually controlled by the control system 25 (FIG. 1) of the tufting machine so as to be selectively fired, as needed, according to the movement of the stepping or shifting needle bar. As a result, for each step or shift of the needle bar according to the pattern, each level cut looper actuator will be controlled individually so as to selectively engage or retract its clip to enable selected loops of yarns to be picked from the needles by the level cut loop loopers and held for cutting, thus forming cut pile tufts. In their extended positions, the clips will cause the loops of yarns engaged by the level cut loop loopers to be released to form either loop pile tufts, or which will be pulled low or back-robbed by operation of the pattern yarn feed attachment controlling the feeding of such yarns, to hide or bury the non-selected ends of these yarns within a particular color field being formed according to the pattern instructions.

As the needles are retracted from the backing material during their reciprocal movement in the direction of arrow 37' (FIG. 2), the feeding of the yarns by the pattern yarn feed attachments or yam feed mechanisms 27/28 (FIG. 1) also will be controlled as indicated at step 107 (FIG. 7). The feeding of the yarns of the non-selected colors (i.e., the colors that are to be hidden and thus not visible in the particular color fields of the pattern being sewn at that step) will be controlled so that these yarns will be back-robbed or pulled low, or even pulled out of the backing material by the yarn feed mechanisms feeding each of these yarns. The effective stitch rate being run by the yarn color placement system of the present invention further provides for a denser field of stitches or tufts, so that the yarns being pulled low or backrobbed are effectively hidden by the remaining cut and/or loop pile tufts formed in the backing material.

The control of the yarn feed by the yarn feed pattern attachments for the control of the feeding of yarns of a variety of different colors, in conjunction with the operation of each shift mechanism and level cut loop loopers or hooks and/or cut pile hooks and loop pile hooks, and with the backing material being run at an effective or operative stitch rate that is substantially increased or denser than stitch rates solely based upon gauge of the machine enables the yarn color placement system of the present invention to provide for a greater variety of free-flowing patterns and/or patterns with a loom-formed appearance to be formed in the backing material. As indicated at step 108 in FIG. 7, the operation of the yarn color placement system continues, and is repeated for each stitch of the pattern until the pattern is complete.

It will be understood by those skilled in the art that while the present invention has been discussed above with reference to particular embodiments, various modifications, additions and changes can be made to the present invention without departing from the spirit and scope of the present invention.

What is claimed:

1. A tufting machine for forming tufted articles having a pattern with a desired stitch rate and including tufts of yarns, the yarns including at least a first yarn and a second yarn, the machine comprising:

at least one needle bar having needles;

backing feed rolls supplying a backing material to the tufting machine;

a pattern yarn feed mechanism feeding the yams to the needles;

at least one needle bar shifter for shifting the at least one needle bar;

gauge parts below the needles; the gauge parts positioned to engage the needles of the at least one needle bar as the needles are reciprocated into the backing material to form loops of the first yams and the second yams in the backing material; and a control system controlling the feeding of the backing material at an effective stitch rate that is greater than the desired stitch rate for the pattern and controlling the pattern yarn feed mechanism and the at least one needle bar shifter to control feeding of the yarns to the needles as the needles are reciprocated into and out of the backing material and shifted to place loops of the first yams and the second yams in the backing material and retain loops of selected yarns, chosen from the first yarns and the second yarns, to form tufts of the first yarns and the second yarns at a desired pile height, and to pull non-selected yarns substantially out of the backing material, to form fields of tufts of the selected first yarns and second yams in the backing material with a number of tufts per inch of the tufts of the selected first yams and second yarns retained in the backing material approximately equal to the desired stitch rate.

2. The tufting machine of claim 1 wherein the gauge parts comprise a plurality of level cut loop loopers, each having a series of extensible clips, a series of actuator connectors configured to connect an output shaft of an actuator to each of the clips for movement of the clips between extended and retracted positions for forming loop pile and cut pile tufts, and an extension portion extending forwardly from and at an angle with respect to the actuator connectors and configured to receive one of the clips of one of the level cut loop loopers.

3. The tufting machine for claim 1 wherein the pattern yam feed mechanism comprises a series of yarn feed rolls each feeding at least two yarns per feed roll to selected needles.

4. The tufting machine of claim 1 wherein the pattern yarn feed mechanism comprises a scroll attachment, a roll attachment, a double end yarn feed attachment, or a single end yarn feed attachment.

5. The tufting machine of claim 1 wherein the gauge parts comprise cut pile hooks, loop pile loopers, level cut loop loopers, and/or combinations thereof.

6. The tufting machine of claim 1 wherein the at least one needle bar comprises dual shifting needle bars, with each of the dual shifting needle bars having a series of needles arranged there along.

7. The tufting machine of claim 1 wherein the first yarn and the second yam are different colors.

8. The tufting machine of claim 7 wherein the pattern further comprises additional yarns of different colors, and the at least one needle bar shifter shifts the at least one needle bar by a number of steps approximately equal to a number of different colors of yarns used in the pattern.

9. A method of tufting an article including tufts of a number of different color yarns arranged in a pattern having a desired stitch rate, the method comprising:

feeding a backing material through a tufting machine at an effective stitch rate that is increased over the desired stitch rate of the pattern;

reciprocating a plurality of needles to deliver the yarns into the backing material to form loops of the yarns;

shifting at least some of the plurality of needles according to a shift profile of the pattern; and controlling feeding of the yarns to the plurality of needles as the plurality of needles are shifted and are reciprocated into and out of the backing material to form the yarn loops at varying pile heights, wherein controlling the feeding includes removing at least some of the yam loops delivered into the backing material to form pattern fields of tufts of selected yarns;

repeating the feeding, the reciprocating, the shifting, and the controlling feeding of the yarns for successive stitches of the pattern to form the pattern of the tufted article with a density of tufts per inch of yarns of one or more colors that are to be visible in a selected field of the pattern approximately equivalent to the desired stitch rate of the pattern to hide yarns not to be shown in the selected pattern field and to avoid gaps in the pattern field.

10. The method of claim 9 wherein the controlling feeding of the yarns comprises back-robbing the non-selected yarns to a height sufficient to be substantially hidden among high tufts formed in the selected field of the pattern.

11. The method of claim 9 wherein the controlling feeding of the yarns comprises controlling each yarn of the yarns fed to each needle of the plurality of needles to selectively form tufts of yarns to be visible in the pattern fields and to substantially remove yarns that are not to be visible in the pattern fields low or out of the backing material.

12. The method of claim 9 wherein at least three different colors of yarns are used in the pattern and the effective stitch rate is at least about two times the desired stitch rate for the article as based upon a gauge of the tufting machine.

13. The method of claim 12 further comprising forming a number of different pile height tufts of yarns of one or more of the three colors of yarns that are to be visible in the selected field of the pattern in each tuft row that is substantially equivalent to the desired stitch rate for the pattern.

14. The method of claim 9 wherein, for each stitch of the pattern, shifting at least some of the plurality of needles a number of steps approximately equivalent to the number of colors of yarns.

15. The method of claim 14 wherein shifting at least some of the plurality of needles further comprises moving the needles at least two steps in a stepping pattern.

16. The method of claim 9 wherein the needles are mounted along the at least one needle bar and wherein shifting at least some of the needles comprises shifting the at least one needle bar in a first direction and in a second direction, wherein the second direction is opposite the first direction.

17. A tufting machine for forming tufted carpets having a pattern with a desired stitch rate and including tufts of yarns of different colors, the tufting machine comprising:

at least one needle bar having needles;

backing feed rolls supplying a backing material to the tufting machine;

a pattern yarn feed mechanism feeding the yarns to the needles;

at least one needle bar shifter for shifting the at least one needle bar;

a plurality of level cut loop loopers reciprocable into engagement with the needles of the at least one needle bar as the needles are reciprocated into the backing material to form loops of the first yarns and the second yarns in the backing material, each of the level cut loop loopers having a clip moveable between extended and retracted positions; and a control system controlling the feeding of the backing material at an increased stitch rate that is greater than the desired stitch rate for the pattern and controlling the pattern yarn feed mechanism and the at least one needle bar shifter to control shifting of the needles and feeding of the yarns to the needles as the needles are reciprocated into and out of the backing material to place loops of the first yarn and the second yarn in the backing material and retain loops of yarns to form tufts of the selected yarns at a desired pile height and to pull non-selected yarns substantially out of the backing material, with a density of tufts per inch of the selected yarns retained in the backing material substantially equal to the desired stitch rate of the pattern, and which avoids gaps appearing within color fields of the pattern; and, wherein the control system moves the clips of selected level cut loop loopers between extended and retracted positions for forming loop pile and cut pile tufts.

18. The tufting machine of claim 17 further comprising a series of actuators connected to the clips of the level cut loop loopers and operable by the control system to move the clips between the extended and retracted positions.

19. The tufting machine of claim 18 further comprising a series of connectors each including an extension portion extending and configured to receive and connect one of the clips of one of the level cut loop loopers to one of the actuators.

* * * * *